US005400851A

United States Patent [19]

Prinz et al.

[11] Patent Number: 5,400,851

[45] Date of Patent: Mar. 28, 1995

[54] PROCESS OF PRODUCING MONOTECTIC ALLOYS

[75] Inventors: Bruno Prinz, Oberursel; Alberto Romero, Frankfurt am Main, both of Germany

[73] Assignee: Metallgesellschaft Aktiengesellschaft, Frankfurt am Main, Germany

[21] Appl. No.: 647,094

[22] Filed: Jan. 29, 1991

[30] Foreign Application Priority Data

Feb. 2, 1990 [DE] Germany ..... 40 03 018.0

[51] Int. Cl.[6] ..... B22D 11/00; B22D 11/124

[52] U.S. Cl. ..... 164/462; 164/487; 164/423

[58] Field of Search ..... 164/462, 463, 423, 487

[56] References Cited

U.S. PATENT DOCUMENTS 3,771,982 11/1973 Dobo ..... 164/462
4,198,232 4/1980 Parr et al. .
4,202,404 5/1980 Carlson ..... 164/463
4,708,194 11/1987 Mohn ..... 164/463

FOREIGN PATENT DOCUMENTS 2182876 5/1987 United Kingdom .
04377 7/1987 WIPO .

OTHER PUBLICATIONS

"Structure Of Monotectic Alloys Rapidly Cooled From The Melt", pp. 88–93. by Dobatkin et al (Moscow).

*Primary Examiner*—Kuang Y. Lin
*Attorney, Agent, or Firm*—Sprung Horn Kramer & Woods

[57] ABSTRACT

In a process of producing monotectic alloys having a relatively large miscibility gap in a liquid state and having in a solidified state a minority phase, which is included in the matrix and has the shape of droplets and has a higher density than the matrix, a molten material which is heated above the segregation temperature is continuously cast at a high casting speed end cooling rats. In order to achieve a sufficiently good disoersion of the minority phase the molten material is cast in a vertical direction.

12 Claims, 1 Drawing Sheet

PROCESS OF PRODUCING MONOTECTIC ALLOYS

DESCRIPTION

This invention relates to a process of producing monotectic alloys having a relatively large miscibility gap in a liquid state and having in a solidified state a minority phase, which is included in the matrix and has the shape of droplets and has a higher density than the matrix, which alloys are produced in that a molten material which is heated above the segregation temperature is continuously cast at a high casting speed and cooling rate.

When monotectic alloys having a high difference in density between the segregated liquid phases and a large segregation temperature difference are heated above the segregation temperature, gravitation will cause a settling and coagulation of the minority phase, which has a relatively higher specific gravity and is present in the shape of droplets when temperatures near the miscibility gap are reached. In accordance with Stokes' law the settling velocity is proportional to the square of the droplet diameter. For this reason the presence of droplets which differ in diameter will tend to increase the frequency or the occurrence of a collision of particles and coalescence of droplets so that settling is accelerated further. In the previous practice it has not been possible entirely to prevent a settling of particles under the action of gravitation.

For this reason a sufficiently uniform dispersion of the droplets in the matrix can only be achieved if the content of the dispersed phase is relatively low and/or cooling is effected at an extremely high rate. It has been proposed in Z. Russ. Mot. 1979 (1), pages 88 to 93 (in English) that aluminum alloys containing up to 33% lead and up to 10% bismuth should be heated to a temperature which is 200° to 250° C. above the solidus isotherm and 150° to 200° above the segregation isotherm and the droplets of the molten material which has been atomized under the action of centrifugal force should be sprayed into water within less than 0.1 second, wherein a cooling rate of $10^3$ to $10^4$ is reached the minority phase is in a state of fine dispersion of the droplets. GB-A 2,182,872 discloses the production of binary alloys such as aluminum-lead alloys, copper-lead alloys and copper-indium alloys in a strip-casting process in which the alloy which is a perfect solution in a molten state is cast at a cooling rate of $10^5$ to $10^6$ K/s so that a uniform dispersion of the fine lead or indium particles in the aluminum, or copper matrix is obtained. That process can be used only to make very thin cast strips having a thickness below 1.0 mm and such strips cannot be processed further, e.g., by being clad onto steel. US-A-4,106,232 is concerned with the production of a monotectic alloy in a process in which aluminum or zinc alloys which contain bismuth and lead and are in a molten stated are doped with a transition metal, such as iron, so that the liquid-solid interlayer of the system is destroyed and a cellular structure having a directed solidification will be obtained at predetermined temperature gradients and a low solidification rate. In that process the spherical particles of the minority phase are allegedly uniformly dispersed in the matrix. That process has not gained significance in practice. WO-A-87/04377 discloses a casting process in which a molten aluminum bearing alloy which contain 4% by weight load and may contain other components in a total up to 10% is poured as a layer having a thickness of 1 to 5 mm onto the water-cooled surface of the steel belt of a rotary strip-casting machine so that the molten material, which is at a temperature above 900° C., is cooled to a solidification temperature of about 650° C. within less than 0.1 second. It is claimed that lead particles having a size of 50 mm can uniformly be dispersed in the aluminum motrix in that manner. Owing to difficulties in plant technology, particularly as regards the cooling of the casting belt, that process has not been accepted in practice and a settling and coagulation of the minority phase cannot sufficiently be avoided with strip thicknesses above 1 mm.

But the processes described hereinbefore have not gained significance in practice because the complex processes involved in the segregation and solidification of the molten alloy cannot sufficiently be controlled.

It is an object of the present invention to carry out the continuous casting process described first hereinbefore in such a manner that the droplets of the minority phase which are dispersed in the matrix are as small as possible and have a spherical shape and are sufficiently uniformly dispersed in the matrix.

That object is accomplished in that the molten material is vertically cast to form a strip or wire having a thickness or diameter of 5 to 20 mm. In that case the direction in which the continuous casting is withdrawn will agree with the direction of the settling of the heavier minority phase by gravity. If the cooling and solidification rates are sufficiently high, a very high temperature gradient will be maintained before the solid-liquid phase limit is reached. As a result the difference between the segregation and solidus isotherms within the system and, the settling distance, will be as short as possible. This is because the temperature range and the settling distance of the droplets of the minority phase are determined by the isotherms of the segregation temperature and by the temperature of the monotectic reaction at which the matrix phase solidifies to enclose, in the then existing distribution, the second phase when it is still liquid.

Owing to the high temperature gradients the dispersed droplets of the minority phase will be subjected to a Marangoni convection, which opposes the Stokes' settling. Because the Marangoni convection takes place in the direction of the temperature gradient and the cooling acts only from the surface of the strip, the Marangoni convention is partly directed inwardly in those regions of the strip which are close to its surface so that the regions which are close to the surface are depleted of the minority phase and the stability of the surface skin will desirably be decreased and subsequent processing steps, such as shaping, cladding or heat-treating, will be facilitated.

Within the scope of the preferred embodiment of the process in accordance with the invention the molten alloy is cast at a constant velocity of 10 to 30 mm/s, preferably of 15 to 25 mm/s and in accordance with a further feature of the invention the cooling rate is 300 to 1500 K/s, preferably 500 to 1000 K/s.

Under such process conditions a steady state can be adjusted and maintained for a long time as regards the solidification and the resulting structure.

Contrary to the processes taking place in binary monotectic alloys, the inhibition of the settling and coagulation processes in ternary systems begins at the beginning of the dondritic primary crystallization because in that case even a relatively small crystal fraction will divide the volume of the molten material into a multiplicity of microvolumes as in a sponge and a phase transfer between such microvolumes will be inhibited.

The process in accordance with the invention can particularly be used to produce materials for sliding surface bearings from aluminum alloys which contain one or more of the following components: 1 to 50% by weight, preferably 5 to 30% by weight, lead; 3 to 50% by weight, preferably 5 to 30% by weight, bismuth; and 15 to 50% by weight indium and, in addition, one or more of the following components: 0.1 to 20% by weight silicon; 0.1 to 20% tin; 0.1 to 10% by weight zinc; 0.1 to 5% by weight magnesium; 0.1 to 5% by weight copper; 0.05 to 3% by weight iron; 0.05 to 3% by weight manganese; 0.05 to 3% by weight nickel; and 0.001 to 0.30% by weight titanium.

The process may also be used to produce zinc alloys which can be used as materials for sliding surface bearings and comprise one or both of the following components: 1 to 30% by weight, preferably 5 to 20% by weight, bismuth; and 1 to 30% by weight lead; and, in addition, one or both of the following components: 0.001 to 50% by weight, preferably 0.001 to 0.2% by weight or 5 to 50% by weight, aluminum and 0.1 to 5% by weight copper.

The process in accordance with the invention may also be used to produce copper alloys comprising 1 to 60% by weight, preferably 12 to 50% by weight, lead.

The process in accordance with the invention may also be used to produce alloys which can be used as materials for special electric conductors and for electric contacts.

In the apparatus used to carry out the continuous casting process in accordance with the invention the container for the molten feed material directly communicates through a casting nozzle which is made of ceramic material and has a flow area that is smaller than the cross-sectional area of the casting with an intensely cooled, vertically permanent mold, in which a short metallic cooling surface is succeeded by means for contacting the continuous casting with water. Such a casting apparatus will ensure a continuous feeding of molten material in the interior of the entire continuous casting. The thermal separation between the hot feeding system and the short permanent mold, which is succeeded by a secondary cooling with water, permits a strong cooling of the continuous casting so that the temperature gradient in front of the solidification front will be very high and the solidified skin of the continuous casting will grow rapidly immediately behind the casting nozzle.

The invention will now be explained more in detail with reference to an illustrative embodiment.

Figure 1:
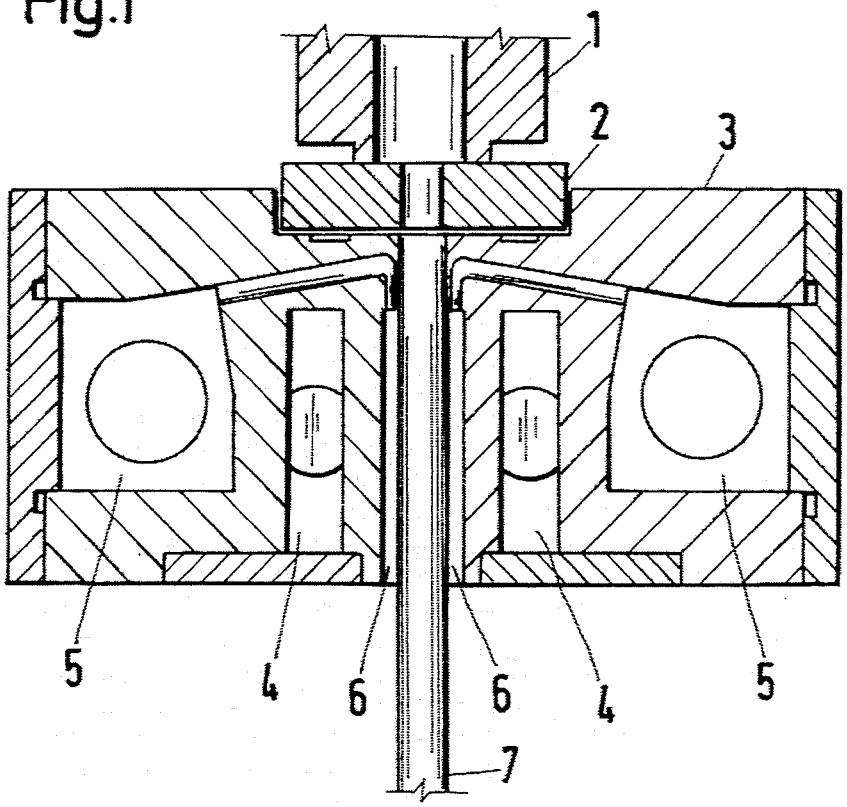
FIG. 1 is a sectional view showing the continuous casting apparatus.
Figure 2:
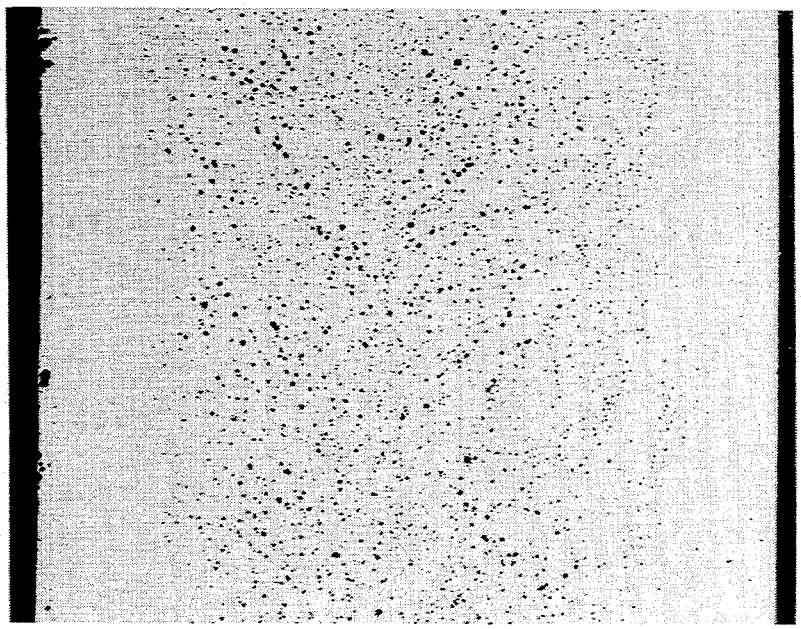
FIG. 2 is a photograph of a cast strip consisting of a ternal monotectic aluminum alloy in a magnification of 1 to 10.

A molten aluminum which comprises 5% bismuth and 5% silicon and is at a temperature above 1000° C. is cast at a velocity of 800 mm/min. The container 1 for the molten feed material, the casting nozzle 2 and the permanent mold 3 provided with the cooling water feeder 4 for cooling the permanent mold before the casting begins and with the cooling water feeder 5 for supplying the cooling grooves 6 with cooling water for directly cooling the strip 7 are so arranged that the temperature gradient in front of the solidification front amounts to 500 K/cm and a certain volume of molten material is cooled at a rate of about 700 K/s. It is apparent from FIG. 2 that the casting strip having a thickness of 10 mm has a substantially uniform structure throughout the length of the strip, which has a thickness of 10 mm. The marginal regions which are depleted of the minority phase owing to the Marangoni convection are distinctly apparent.

What is claimed is:

1. A process for producing monotectic alloys having a relatively large miscibility gap in a liquid state and having in a solidified state a minority phase, which is included in the matrix and has the shape of droplets and has a higher density than the matrix, which comprises heating a molten material above the segregation temperature and continuously casting the molten material vertically at a constant velocity of about 10 to 30 mm/s and cooling rate to form a strip having a thickness of 5 to 20 mm.

2. A process according to claim 1, wherein the molten material is cast at a cooling rate of 300 to 1500 K/s.

3. A process according to claim 1, wherein the molten material is cast at a constant velocity of about 15 to 25 mm/s.

4. A process according to claim 1, wherein the molten material is cast at a cooling rate of 500 to 1000 K/s.

5. A process according to claim 1, wherein the alloy comprises aluminum and at least one of 1 to 50% by weight lead, 2 to 50% by weight bismuth, and 15 to 50% by weight indium; and in addition at least one of 0.1 to 20% by weight silicon, 0.1 to 20% by weight tin, 0.1 to 10% by weight zinc, 0.1 to 5% by weight magnesium, 0.1 to 5% by weight copper, 0.05 to 3% by weight iron, 0.05 to 3% by weight manganese, 0.05 to 3% by weight nickel, and 0.001 to 0.30% by weight titanium.

6. A process according to claim 1, wherein the alloy comprises aluminum and at least one of 5 to 30% by weight lead, 5 to 30% by weight bismuth, and 15 to 50% by weight indium; and in addition at least one of 0.1 to 20% by weight silicon, 0.1 to 20% by weight tin, 0.1 to 10% by weight zinc, 0.1 to 5% by weight magnesium, 0.1 to 5% by weight copper, 0.05 to 3% by weight iron, 0.05 to 3% by weight manganese, 0.05 to 3% by weight nickel, and 0.001 to 0.30% by weight titanium.

7. A process according to claim 1, wherein the alloy comprises zinc and at least one of 1 to 30% by weight bismuth, and 1 to 30% by weight lead; and at least one of 0.001 to 50% by weight aluminum and 0.1 to 5% by weight copper.

8. A process according to claim 1, wherein the alloy comprises zinc and at least one of 5 to 20% by weight bismuth and 1 to 30% by weight lead; and at least one of 0.001 to 0.2% or 6 to 50% by weight aluminum, and 0.1 to 5% by weight copper.

9. A process according to claim 1, wherein the alloy comprises copper and 1 to 50% by weight lead.

10. A process according to claim 1, wherein the alloy comprises copper and 12 to 50% by weight lead.

11. In the making of a sliding surface bearing the improvement which comprises forming said bearing of an alloy produced according to claim 1, whereby the resulting bearing exhibits uniformity.

12. A continuous casting apparatus for producing a monotectic alloy, comprising a container for a molten feed material directly communicating through a casting nozzle made of ceramic material and having a flow area that is smaller than the cross-sectional area of the resulting casting, and an intensely cooled, vertical permanent mold having a short metallic cooling surface succeeded by means for contacting the continuous casting with water, and a cooling water supply.

* * * * *

UNITED STATES PATENT AND TRADEMARK OFFICE

CERTIFICATE OF CORRECTION

PATENT NO. : 5,400,851

DATED : March 28, 1995

INVENTOR(S) : Prinz, et al.

It is certified that error appears in the above-identified patent and that said Letters Patent is hereby corrected as shown below:

Col. 4, line 26 Delete " 2 " and substitute -- 3 --

Signed and Sealed this

Twentieth Day of June, 1995

*Attest:*

Bruce Lehman

BRUCE LEHMAN

*Attesting Officer*

*Commissioner of Patents and Trademarks*